US008919165B2

(12) United States Patent
Cook

(10) Patent No.: US 8,919,165 B2
(45) Date of Patent: Dec. 30, 2014

(54) APPARATUS AND METHOD OF FORMING RECLOSABLE CONTAINERS

(75) Inventor: Steven T. Cook, Miamisburg, OH (US)

(73) Assignee: Dayton Systems Group Inc., Miamisburg, OH (US)

( * ) Notice: Subject to any disclaimer, the term of this patent is extended or adjusted under 35 U.S.C. 154(b) by 0 days.

(21) Appl. No.: 14/113,177

(22) PCT Filed: Apr. 20, 2012

(86) PCT No.: PCT/US2012/034391
§ 371 (c)(1),
(2), (4) Date: Jan. 29, 2014

(87) PCT Pub. No.: WO2012/145588
PCT Pub. Date: Oct. 26, 2012

(65) Prior Publication Data

US 2014/0130560 A1 May 15, 2014

Related U.S. Application Data

(60) Provisional application No. 61/477,336, filed on Apr. 20, 2011.

(51) Int. Cl.

| | |
|---|---|
| ***B21D 26/02*** | (2011.01) |
| ***B21D 39/08*** | (2006.01) |
| ***B21D 26/049*** | (2011.01) |
| ***B21D 51/26*** | (2006.01) |
| ***B21D 26/033*** | (2011.01) |
| ***B21D 51/38*** | (2006.01) |

(52) U.S. Cl.
CPC ..... *B21D 26/033* (2013.01); *B21D 26/049* (2013.01); *B21D 51/2615* (2013.01); *B21D 51/38* (2013.01)
USPC ..... 72/63; 72/57; 72/58; 29/421.1

(58) Field of Classification Search
CPC ..... B21D 22/12; B21D 22/125; B30B 5/02
USPC ..... 72/57, 58, 59, 61, 62, 63; 29/421.1
See application file for complete search history.

(56) References Cited

U.S. PATENT DOCUMENTS

| | | | |
|---|---|---|---|
| 3,142,099 | A | 7/1964 | Burch |
| 3,321,006 | A | 5/1967 | Knapp et al. |
| 5,509,255 | A | 4/1996 | Rutledge |
| 5,522,716 | A | 6/1996 | Ureshino |
| 5,857,358 | A | 1/1999 | De Vries, Jr. et al. |

(Continued)

FOREIGN PATENT DOCUMENTS

WO WO 2005/021388 A2 3/2005

OTHER PUBLICATIONS

PCT/US2012/034391 International Search Report.

*Primary Examiner* — David B Jones
(74) *Attorney, Agent, or Firm* — Fay Sharpe LLP

(57) ABSTRACT

An apparatus for forming a reclosable metal can includes a flexible bladder that receives pressure from at least one end. The bladder is received in movable dies that selectively open and close about the bladder, and more particularly about a metal body received between the bladder and die. The die preferably includes thread or lug profile cavities for forming circumferentially spaced thread lugs in the can body.

17 Claims, 9 Drawing Sheets

(56) References Cited

U.S. PATENT DOCUMENTS

| | | | | |
|---|---|---|---|---|
| 6,015,062 | A | 1/2000 | Bachmann et al. | |
| 6,082,944 | A | 7/2000 | Bachmann et al. | |
| 6,802,196 | B2 | 10/2004 | Mallory et al. | |
| 7,069,763 | B2 | 7/2006 | Cook et al. | |
| 7,191,032 | B2 | 3/2007 | MacEwen et al. | |
| 7,296,449 | B2 * | 11/2007 | Kubacki et al. | 72/63 |
| 7,370,507 | B2 | 5/2008 | Cook et al. | |
| 7,841,222 | B2 | 11/2010 | Cook et al. | |
| 7,861,874 | B2 | 1/2011 | Cook et al. | |
| 2006/0060601 | A1 | 3/2006 | Kubacki et al. | |
| 2008/0251969 | A1 | 10/2008 | Isham et al. | |

* cited by examiner

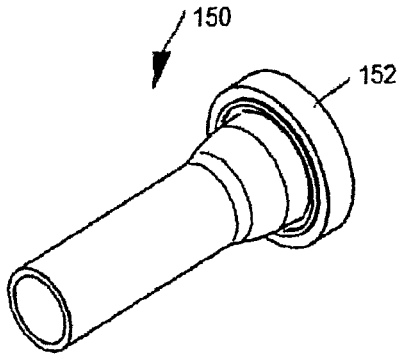
Fig. 6
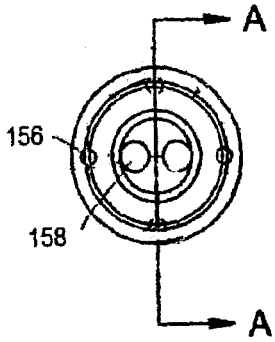
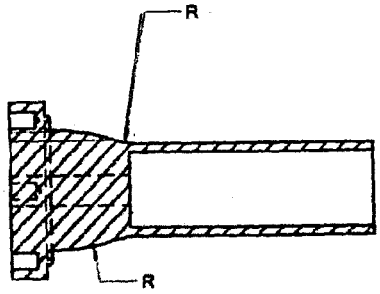

APPARATUS AND METHOD OF FORMING RECLOSABLE CONTAINERS

This national stage application is a submission under 35 U.S.C. 371 of PCT International Patent Application No. PCT/US2012/034391, filed on 20 Apr. 2012, and claims the priority benefit of U.S. Provisional Application No. 61/477,336, filed on Apr. 20, 2011, the disclosures of which are incorporated herein by reference.

BACKGROUND OF THE DISCLOSURE

This disclosure relates to an apparatus and method of forming reclosable containers, and more particularly reclosable thin-walled metal containers.

It is known in the art to form thin-walled reclosable metal containers in a press, and typically a press modified with multiple tooling stations. For example, there is a substantial cost associated with the purchase of a press and tooling for manufacturing reclosable metal containers. This includes related equipment for feeding and transferring blank material, partially completed components, and final components, along with the cost of related controls. As a result, a significant expenditure is incurred with regard to the equipment for forming metal cans having reclosable caps.

It is also known to use air or other pneumatic or hydraulic processes to form metal articles. For example, U.S. Pat. No. 7,191,032 generally describes such an arrangement. However, these arrangements use air or nitrogen pressure. The air and/or nitrogen gas must be pressurized or amplified to a high pressure in order to complete the desired metal forming. Accordingly, there is a cost for pressurizing and handling the gas required to accomplish such forming. Further, the air and nitrogen must be subsequently disposed of during cycling of the article formation. In still other instances, it has been suggested to elevate the temperature of the can body in an effort to assist in such formation.

Thus, a continued need exists for a new apparatus and method that is cost efficient and effective in forming reclosable metal cans.

SUMMARY OF THE DISCLOSURE

An apparatus for forming a reclosable metal can includes a flexible bladder that receives pressure from at least one end. The bladder is received in movable dies that selectively open and close about the bladder, and more particularly about a metal body received between the bladder and die.

An associated hydraulic system provides high pressure to an interior of the bladder to urge the bladder against the metal body and urge the metal body against the die.

The die preferably includes thread or lug profile cavities for forming circumferentially spaced thread lugs in the can body.

Subsequently, the body is removed from between the die and bladder for one or more curling steps.

A preferred method of forming a can body with integrated thread lugs includes pressurizing a bladder against a wall surface of a metal body, and deforming select regions of the metal body into die cavities.

In one exemplary embodiment, the metal body is radially positioned between a body on an inner surface of the wall, and movable die portions on the outer surface. Pressurized fluid is then introduced into the bladder and the bladder radially expands the metal body into the cavities of the die.

The method further includes sealing first and second ends of the bladder and introducing pressurized fluid from at least one end.

A primary benefit relates to the decreased cost associated with manufacture of a metal can having integrated thread lugs.

Still another benefit is the reduced number of manufacturing steps associated with the manufacture of a metal can having integrated thread lugs.

Still other benefits and advantages of the present disclosure will become more apparent to those skilled in the art upon reading and understanding the following, detailed description.

BRIEF DESCRIPTION OF THE DRAWINGS

FIG. 6 is a perspective view of a center post.

DETAILED DESCRIPTION OF THE PREFERRED EMBODIMENTS

Figure 1:
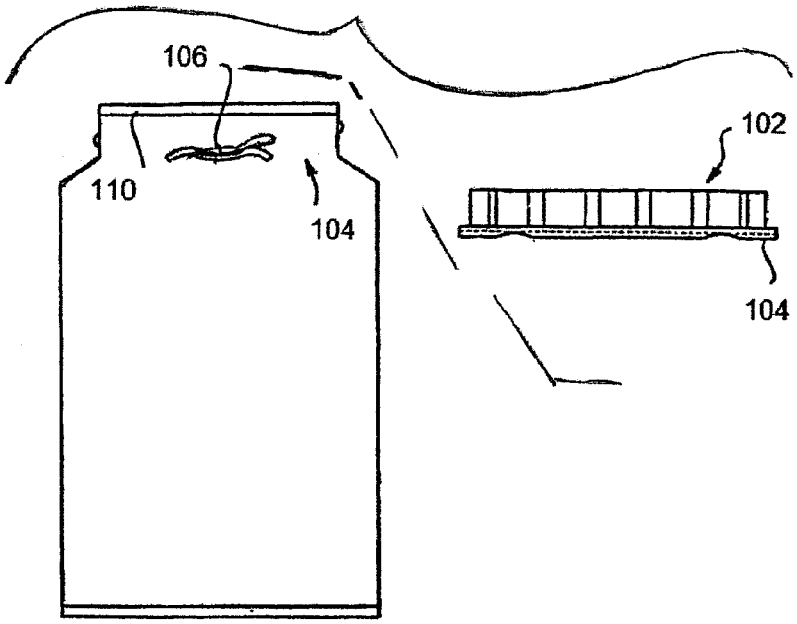
FIG. 1 is a metal can with integrated thread lugs and a resealable cap.
Figure 2:
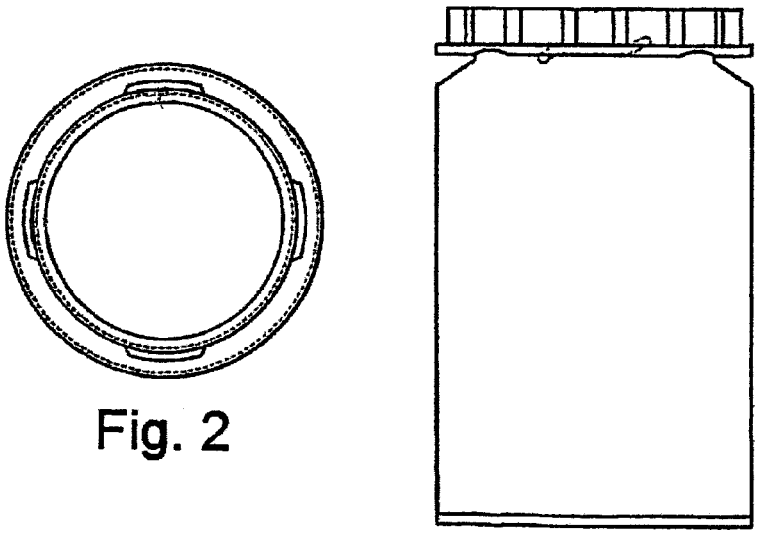
FIG. 2 is a plan view of the resealable cap.

Commonly-owned published application WO 2005/021388 generally shows and describes forming a metal can body having integrated thread lugs that cooperate with a resealable cap. FIG. 1 is representative of these two individual components of the can assembly, i.e., the body 100 and the cap 102. In an upper or neck region 104 of the body, there are provided circumferentially spaced thread lugs 106 that cooperate with inwardly extending flanges 108 (FIG. 2) of the cap 102 to seal the cap to an outwardly curled end portion 110 of the body. Preferably flange 108 of the cap cooperates with a corresponding thread lug on the body so that a reclosable pressurized can body is provided. More particular details of such can bodies and associated caps may be found in the noted international application, as well as commonly-owned U.S. Pat. Nos. 6,015,062; 6,082,944; 7,069,763; 7,370,507; 7,841,222; and 7,861,874, the disclosures of which are expressly incorporated herein by reference.

Figure 3:
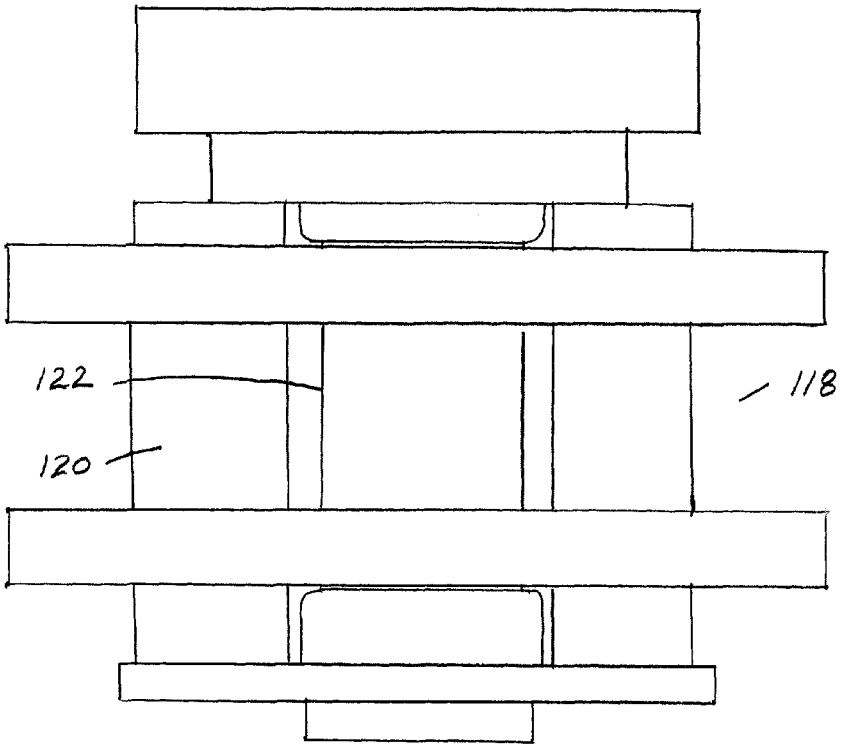
FIG. 3 is across-sectional view through an apparatus for forming the can body.
Figure 4:
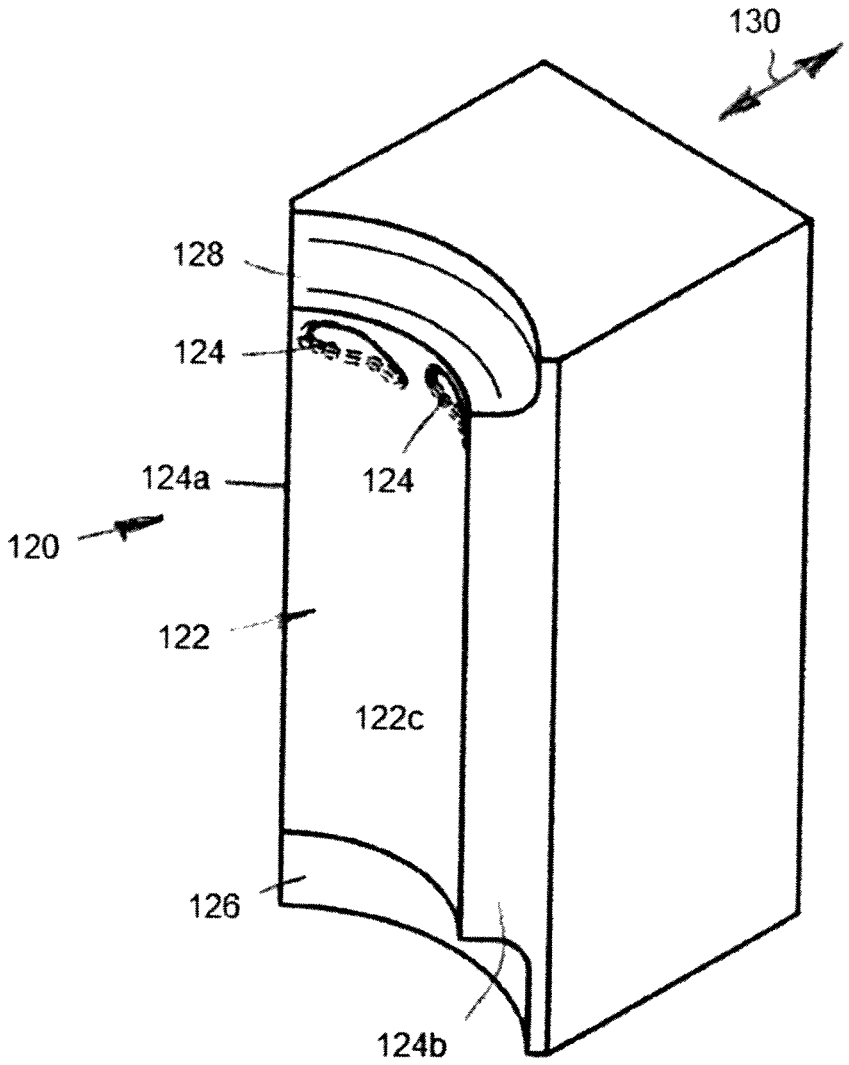
FIG. 4 is a perspective view of one die portion that includes integrated thread portions.
Figure 5:
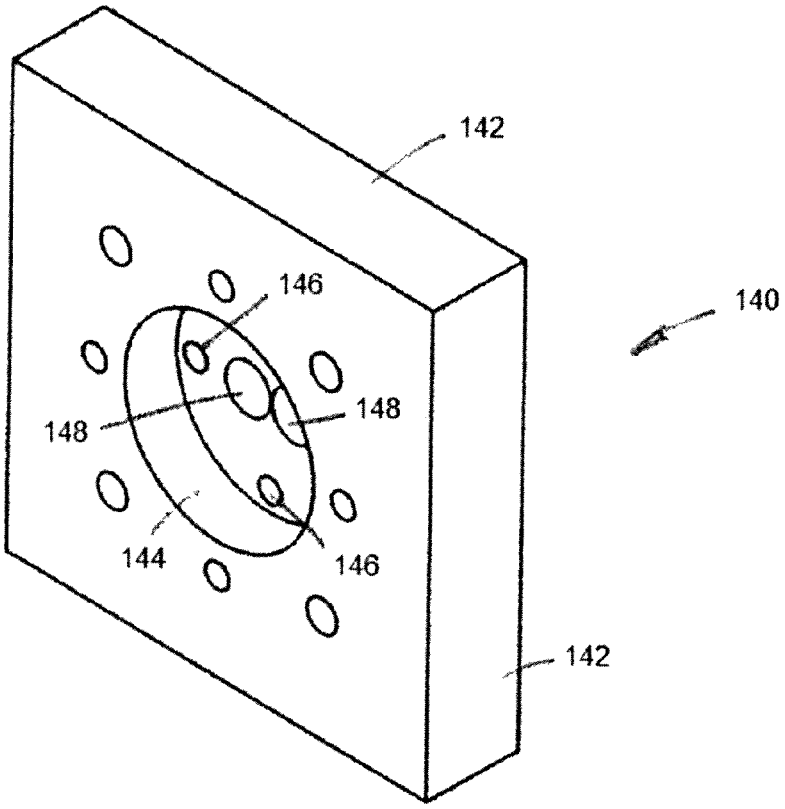
FIG. 5 is a perspective view of a center post mounting plate.
Figure 7:
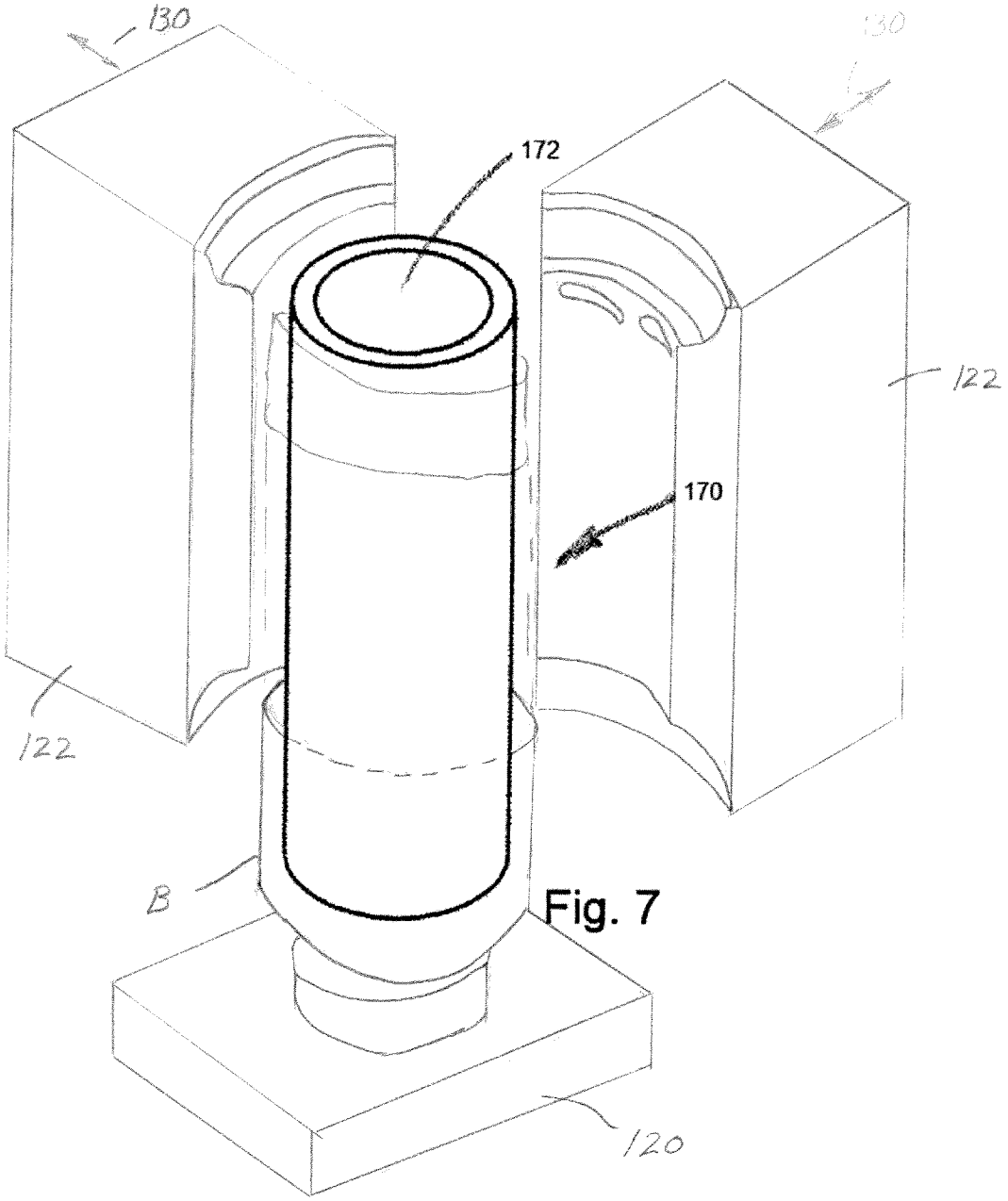
FIG. 7 is a perspective view of the bladder that is received over the center post with plural dies with integrated thread portions disposed therearound and a workpiece received therebetween.
Figure 8:
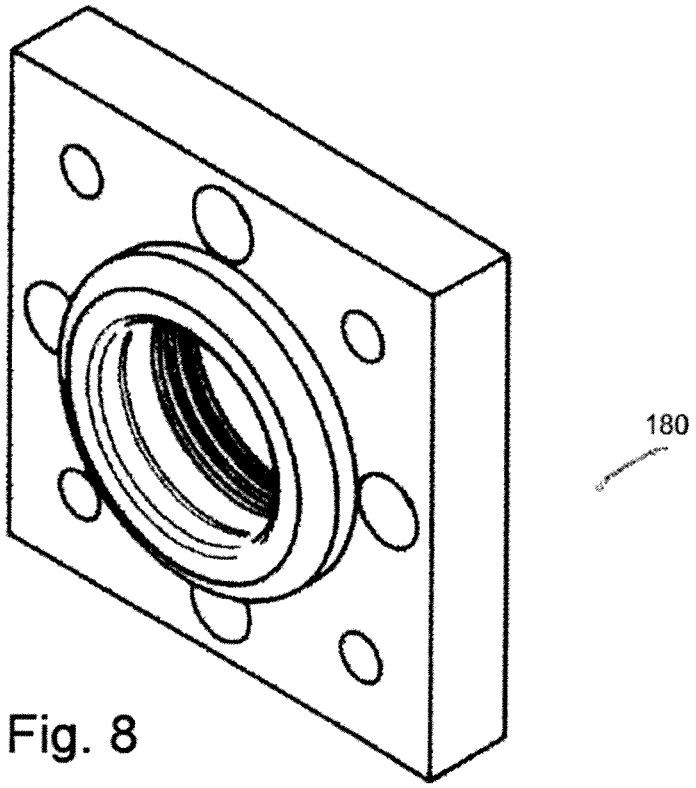
FIG. 8 is a perspective view of a clamp plate.
Figure 9:
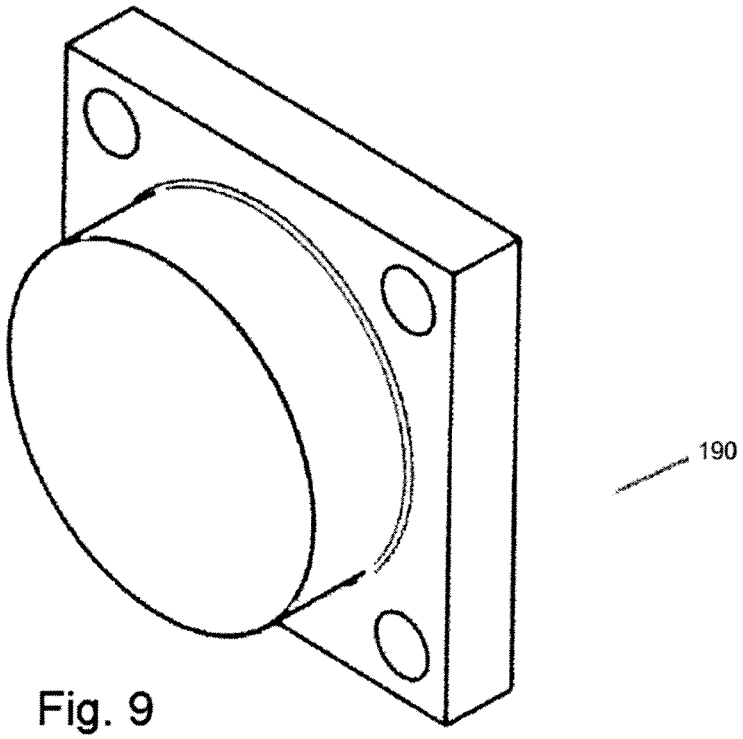
FIG. 9 is a perspective view of the bottom plug.
Figure 10:
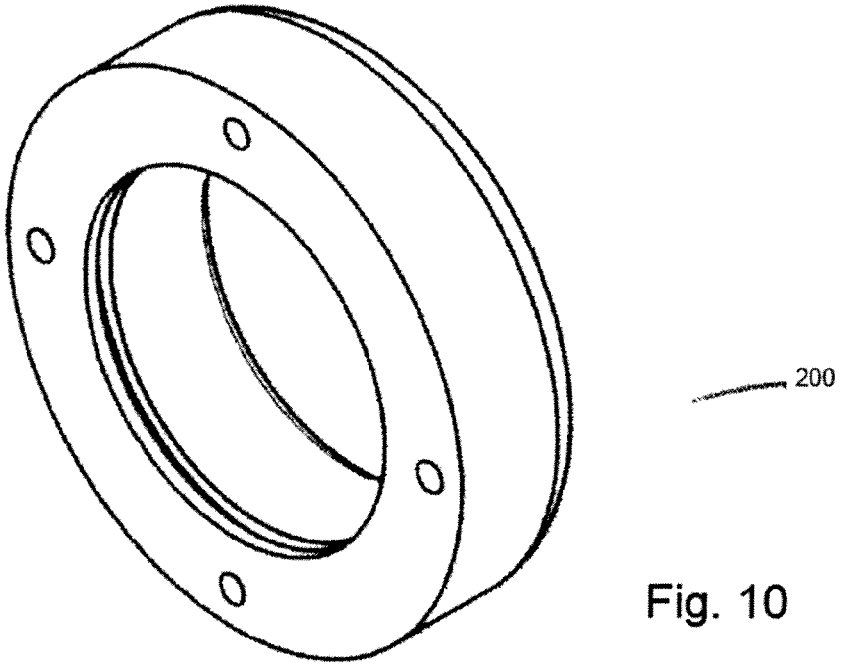
FIG. 10 is a perspective view of the lower ring.
Figure 11:
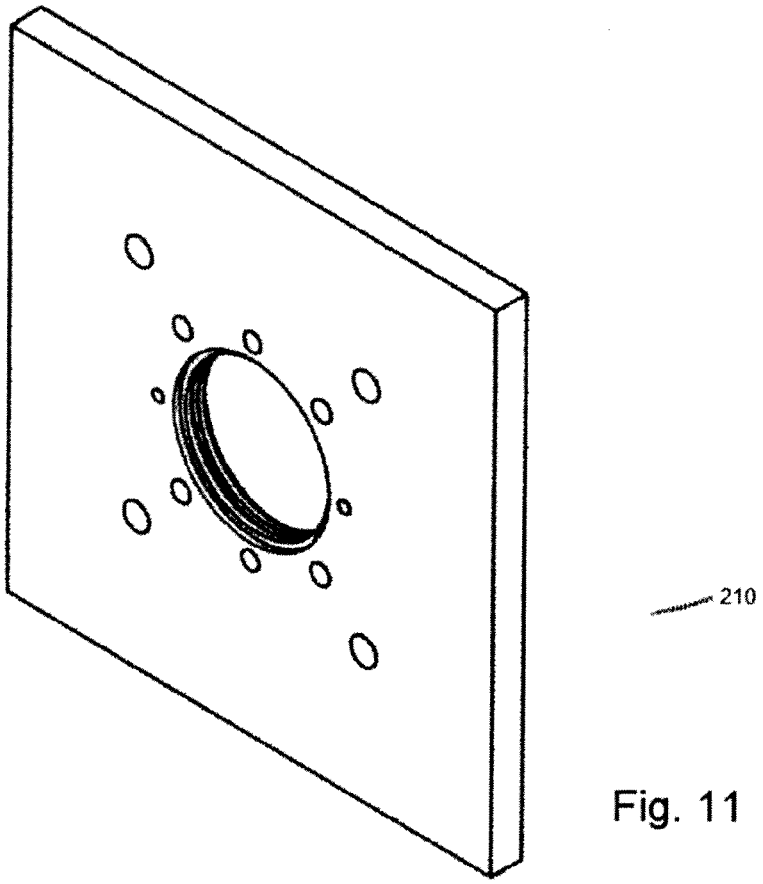
FIG. 11 is a perspective view of the lower base plate.
Figure 12:
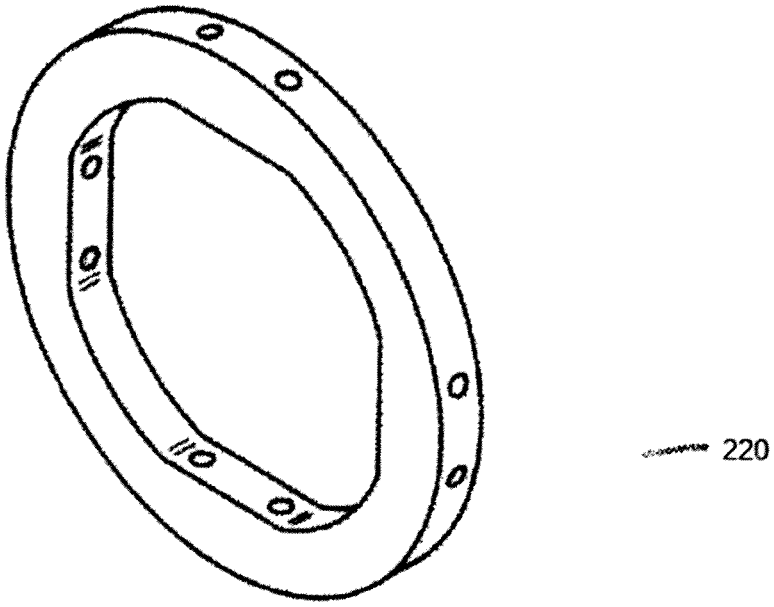
FIG. 12 is a perspective view of one of the clamp rings.

FIG. 3 is a view partially in cross-section of an assembly for simplifying formation of such a can body 100. The forming assembly includes a die 118, preferably formed by cooperating die portions 120 (one of which is shown in FIG. 4) that cooperate to form a cavity 122. In the exemplary embodiment, each of four die portions 122 are identical or substantially identical in structure, although one skilled in the art will appreciate that differences may be provided in one or more of the die portions if desired. Each die portion is dimensioned to form, for example, one-fourth of the total die surface and abuttingly engage one another along faces 120*a*, 120*b* for sealing engagement with a similar face of an adjacent die portion. More particularly, die portion 122 has a generally arcuate or curvilinear inner die cavity surface 122*c* that forms a major portion of the can body. At one end, namely a first or upper end, die cavities 124 are formed in spaced relation along the arcuate surface 122*c* to, in turn, form the integrated thread lugs 106 in a manner to be described below. A first or lower recess 126 and similarly a second or upper recess 128 are formed in the die portion.

Each die portion 122 is preferably formed of a material that is sufficiently hard (tool steel) to deform a workpiece such as a metal body (aluminum or steel) when the metal body is forced against the die under the influence of pressure or force imposed thereon. In this particular system, the metal body is either a hollow cylinder or cup-shaped member having a bottom wall and a sidewall formed as one piece. Typically, the sidewall includes a seam that extends along a length thereof and therefore the seam is preferably located so as not to be received in one of the thread cavities 124 of the die portion. Without limiting the present disclosure, an aluminum body may have a wall thickness on the order of 0.003-0.006 or a steel body will have a wall thickness of approximately 0.006-0.010.

Each die portion 122 is preferably mounted on a slide or rail (not shown) for generally radial movement as represented by reference numeral 130. The die portions are preferably actuated by a first hydraulic circuit (not shown) so that the individual die portions 122 can be moved away from one another for loading the metal body in the die (or removing a completed metal body) and likewise moved toward one another in abutting, sealing engagement along the mating surfaces 124*a*, 124*b* during the forming process.

With continued reference to FIGS. 3 and 4, and additional reference to FIGS. 5-12, selected components of the forming assembly will be shown and described in greater detail. Particularly, a center post mounting plate 140 (FIG. 5) and center post 150 (FIG. 6) are received in the die cavity (FIG. 3). In a simple form, the center post mounting plate 140 has a square perimeter 142 (although this conformation is not a necessity) and a central recess 144 that is dimensioned to receive enlarged end 152 of the center post 150. Fasteners (not shown) interconnect the mounting plate 140 and the center post 150, and likewise to a base plate through fastener receiving openings 146, 156, respectively, in a manner to be described further below. Further, the mounting plate and the center post include respective fluid openings 148, 158 that operatively communicate with a second hydraulic circuit (not shown). The second hydraulic circuit selectively introduces and removes hydraulic fluid for the purpose of deforming the metal body against the die surface. As will be appreciated, the center post has a central opening along its length that communicates with the fluid openings 148, 158, and has a central longitudinal axis that extends in generally co-linear relation with a longitudinal axis of the die when the individual die portions are brought together.

Received around the center post 150 is a flexible bladder 170 (FIG. 7) which in the preferred embodiment adopts a hollow cylindrical sleeve configuration. The hollow sleeve 170 is preferably a urethane construction in the exemplary arrangement having a wall thickness of approximately 0.50", although the wall thickness may vary depending on the particular details of the metal body and the required deformation. Pressurized fluid, e.g., hydraulic fluid, is introduced into the interior 172 of the bladder and the flexible sleeve defining the bladder is expanded outward into engagement with the metal body B. The pressure level is pre-selected and is sufficient to expand the sleeve 170 outwardly and deform the metal body B beyond its elastic limit such that the metal body conforms to the contour of the die cavity preferably defined by multiple die portions 122. The die portions when closed abut one another and define a continuous inner surface forming a die cavity having a slightly greater diameter dimension than the metal body B. In this arrangement, any seam in the metal body is oriented so as not to overlie one of the thread cavities 124. It will also be appreciated that functional features are formed in the metal such as the thread lugs or a neck that tapers from a large diameter to a small diameter adjacent the opening in the top of the container. Likewise, decorative or aesthetic features can be embossed in the metal body by forming a mirror-image of such features in the die surface. By detecting a location of the seam or some other indicia on the metal body, the body can be oriented in a desired position so that functional and aesthetic features can be precisely located.

The clamp plate 180 (FIG. 8), bottom plug 190 (FIG. 9), lower ring 200 (FIG. 10), lower base plate 210 (FIG. 11), and clamp rings 220 (FIG. 12) are assembled together to hold the center post, bladder, and metal body in position, and to seal the upper and lower ends during the forming operation. Of course, the die portions 120 are free to move a limited dimension in a radial direction in order to separate from the formed can body and receive a new metal body in the die cavity and around the hollow sleeve (i.e., move radially outward) and to abut the die portions together along surfaces 124*a*, 124*b* (i.e., move radially inward) in order to seal the die cavity, sleeve, and metal body during the forming operation.

The first hydraulic circuit is preferably used to advance and retract the die portions toward and away from one another. For example, each die portion is mounted on a slide or rail and a hydraulic piston/cylinder assembly (not shown for ease of illustration) is selectively pressurized to advance and retract the die portions. Further, once the die portions 122 are brought into abutting engagement, the hydraulic cylinder will apply a holding force that resists the outward deforming force applied by the expanding hollow sleeve against the metal body during the forming operation. Once the metal body is formed, the holding force is released, and the die portions retracted to allow the formed metal body to be removed from die cavity and a new metal body inserted. Of course, operation of the second hydraulic circuit that pressurizes the bladder is coordinated with the first hydraulic circuit in order to facilitate automated, repeatable forming of the metal bodies.

The formation of the integrated thread 106 in the can body is one step in the reclosable metal can. After the metal body with integrated thread is removed from the forming apparatus of FIG. 3, a subsequent curling operation is preferably performed on the open, upper end of the metal body. Details of the curling operation are generally known in the art; however, formation of the outward curl is preferably after formation of the thread lugs in order to maintain the desired dimensional precision of the thread, curl, and cap. Particularly, the dimension between the curl surface and the thread lugs is precise by forming the lug based on the location of the previously formed thread lugs. This assures that the proper closing and sealing force is applied between the cap (and the seal typically provided on an underside of the cap) and the can body.

By using the flexible bladder, the interior of the metal body (and likewise the resultant can body) is not potentially contaminated by the hydraulic fluid. The metal bodies can be easily expanded into desired internal volumes. Further, the elimination of presses, feeder, and transfer equipment, and the reduced costs of replacement tooling since tool wear on the die cavity and bladder will not be as severe, result in a significant reduction in equipment and capital costs. The new process will have a significantly reduced number of steps also, from eight or more steps in the current forming process to perhaps two or three steps. Providing aesthetic features that are embossed in the can not only adds unique designs and shapes to the final article, but also can be used to either reduce or eliminate print material applied to a can body.

The disclosure has been described with reference to the preferred embodiments. Modifications and alterations will occur to others upon reading and understanding this specification. It is intended to include all such modifications and alterations in so far as they come within the scope of the appended claims or the equivalents thereof.

Having thus described the invention, I claim:

1. An apparatus for forming a reclosable metal can comprising:

an inflatable flexible bladder;

a die having a cavity disposed adjacent the bladder, and dimensioned to receive an associated metal body having a seam extending along a length thereof therebetween whereby in response to fluid pressure the flexible bladder engages surface portions of an associated metal body and deforms the associated surface portions into the die cavity, the die includes thread lug portions therein at circumferentially spaced locations, and the seam of the associated metal body oriented so as not to overlie any one of the thread lug portions.

2. The apparatus of claim 1 further comprising a source of hydraulic fluid and pressure for selectively inflating the flexible bladder.

3. The apparatus of claim 1 further comprising a mechanism for opening and closing die portions that form the die and cavity whereby the associated metal body is introduced to and removed from the cavity.

4. The apparatus of claim 1 wherein the flexible bladder is a hollow sleeve received in the die.

5. The apparatus of claim 4 wherein the flexible bladder is sealed at a first end and a passage provided at a second end for selectively introducing hydraulic fluid into the flexible bladder.

6. The apparatus of claim 1 further comprising a center post received in the hollow sleeve of the flexible bladder.

7. The apparatus of claim 1 wherein the flexible bladder has a sidewall thickness on the order of 0.5 inches.

8. The apparatus of claim 7 wherein the flexible bladder is formed of urethane.

9. The apparatus of claim 7 wherein the flexible bladder is a hollow sleeve opened at first and second ends.

10. The apparatus of claim 1 further comprising a curling station that receives the associated metal body upon removal from the die that forms an outward curl on an open end of the associated metal body whereby a dimension between a curl surface and the thread lugs is precisely maintained.

11. A method of forming a reclosable metal can body comprising:

providing a die having thread lug cavities disposed in circumferential spaced locations;

positioning a flexible bladder adjacent the die;

inserting a metal sleeve, having a seam extending along a longitudinal length thereof, between the bladder and the die in an orientation so that the seam does not overlie any one of the thread lug cavities;

pressurizing the bladder to deform the metal sleeve against the die;

depressurizing the bladder to separate the bladder from the deformed metal sleeve; and removing the deformed metal sleeve from between the bladder and die.

12. The method of claim 11 wherein the pressurizing step includes introducing pressurized fluid into an interior of the hollow flexible bladder.

13. The method of claim 12 wherein the die providing providing step includes abutting separate die portions together.

14. The method of claim 13 wherein the removing step includes separating the die portions from abutting engagement.

15. The method of claim 11 wherein the pressurizing step includes introducing hydraulic fluid at a pressure of approximately 350 psi.

16. The method of claim 11 further comprising using first and second hydraulic circuits to provide hydraulic fluid for the pressurizing/depressurizing of the bladder, and for moving separate die portions toward and away from one another.

17. The method of claim 11 further comprising forming an outward curl on an open end of the associated metal body after removal from the die whereby a dimension between a curl surface and the thread lugs is precisely maintained.

* * * * *